US006384854B1

(12) United States Patent
Ibs et al.

(10) Patent No.: US 6,384,854 B1
(45) Date of Patent: May 7, 2002

(54) PRINTER USING THERMAL PRINT HEAD

(75) Inventors: John J. Ibs, Minneapolis; Robert E. Francis, Richfield; Gary M. Klinefelter, Eden Prairie; Matthew K. Dunham, Eagan, all of MN (US)

(73) Assignee: Fargo Electronics, Inc., Eden Prairie, MN (US)

( * ) Notice: Subject to any disclaimer, the term of this patent is extended or adjusted under 35 U.S.C. 154(b) by 0 days.

(21) Appl. No.: 09/306,860

(22) Filed: May 7, 1999

(51) Int. Cl.[7] ..... B41J 2/36

(52) U.S. Cl. ..... 347/211; 347/188

(58) Field of Search ..... 347/180, 185, 347/211, 188, 183, 186; 400/120.05, 120.01–120.07; 395/105, 101, 104

(56) References Cited

U.S. PATENT DOCUMENTS

| | | | | |
|---|---|---|---|---|
| 4,071,849 A | | 1/1978 | Kayano et al | 346/1 |
| 4,168,421 A | | 9/1979 | Ito | 219/216 |
| 4,284,876 A | | 8/1981 | Ishibashi et al. | 219/216 |
| 4,300,142 A | | 11/1981 | Kos | 346/76 |
| 4,368,491 A | | 1/1983 | Saito | 358/283 |
| 4,399,749 A | | 8/1983 | Arai | 101/211 |
| 4,464,669 A | | 8/1984 | Sekiya et al. | 346/76 |
| 4,475,114 A | | 10/1984 | Koyama et al. | 346/76 |
| 4,679,055 A | | 7/1987 | Inui et al. | 46/76 |
| 4,701,811 A | | 10/1987 | Moriguchi et al. | 358/298 |
| 4,709,149 A | | 11/1987 | Takahashi et al. | 250/317.1 |
| 4,724,446 A | | 2/1988 | Hirahara et al. | 346/76 |
| 4,769,527 A | | 9/1988 | Hart et al. | 219/216 |
| 4,806,950 A | * | 2/1989 | Sekine et al. | 347/185 |
| 4,814,891 A | | 3/1989 | Uchiyama et al. | 358/296 |
| 4,845,514 A | | 7/1989 | Mitsushima et al. | 346/76 |
| 4,884,080 A | | 11/1989 | Hirahara et al. | 346/46 |
| 4,888,601 A | | 12/1989 | Inui | 346/76 |
| 4,890,121 A | | 12/1989 | Hirahara et al. | 346/76 |
| 4,899,170 A | | 2/1990 | Izumi | 346/76 |
| 4,910,603 A | | 3/1990 | Hirahara et al. | 358/298 |
| 4,967,283 A | | 10/1990 | Uchiyama et al. | 358/296 |
| 5,081,529 A | | 1/1992 | Collette | 358/80 |
| 5,099,259 A | | 3/1992 | Hirahara et al. | 346/76 |
| 5,120,936 A | | 6/1992 | Shyu et al. | 219/497 |
| 5,126,757 A | | 6/1992 | Yamada | 346/76 |
| 5,170,179 A | | 12/1992 | Chen et al. | 346/76 |
| 5,175,635 A | | 12/1992 | Yamada et al. | 358/467 |
| 5,216,753 A | | 6/1993 | Ng | 395/109 |
| 5,220,349 A | | 6/1993 | Saita et al. | 346/76 |
| 5,308,958 A | | 5/1994 | Gassho | 219/486 |
| 5,309,526 A | | 5/1994 | Pappas et al. | 382/56 |
| 5,337,258 A | | 8/1994 | Dennis | 364/551.01 |
| 5,424,767 A | | 6/1995 | Alavizadeh et al. | 347/17 |
| 5,585,834 A | * | 12/1996 | Nagano | 347/211 |
| 5,636,331 A | | 6/1997 | Klinefelter et al. | 395/109 |
| 5,669,720 A | * | 9/1997 | Nagishi et al. | 3470/180 |
| 5,793,403 A | | 8/1998 | Klinefelter | 347/195 |

FOREIGN PATENT DOCUMENTS

| | | |
|---|---|---|
| JP | 2870574 | 3/1999 |

* cited by examiner

*Primary Examiner*—Huan Tran
*Assistant Examiner*—K. Feggins
(74) *Attorney, Agent, or Firm*—Brian D. Kaul; Westman, Champlin & Kelly

(57) ABSTRACT

A printer for printing an image onto a substrate includes a thermal print head having a plurality of electrical resistors, a supply of coloring material adjacent the print head for deposition on the substrate and a print head controller. The print head controller provides a pulse train output to at least one of the electrical resistors. The pulse train includes a plurality of pulses and at least one pulse has a variable width related to a binary value at least another pulse has fixed width.

13 Claims, 3 Drawing Sheets

PRINTER USING THERMAL PRINT HEAD

BACKGROUND OF THE INVENTION

The present invention relates to thermal printing systems and, more particularly, to a method and apparatus for controlling the heaters on the thermal print head.

A thermal printing system utilizes a thermal print head which includes a substrate onto which a line of resistive heat-generating elements or heaters is deposited. The resistive heaters are uniformly deposited in a single line and very closely together, typically with a resolution of 200 or 300 heaters per inch. An electric current is selectively and controllably applied to each of the heaters in accordance with the information to be thermally transferred to a corresponding pixel on a piece of paper or other medium adjacent to the thermal print head. Usually, the printing is accomplished by thermal transfer between a ribbon and the piece of paper. However, printing can also be accomplished using thermally sensitive paper. Printing on a medium with a thermal print head can be carried out by a process which generates the desired pattern on the paper one line at a time by selectively energizing the heaters as the paper is transferred past the thermal print head. Individual heaters are energized to levels corresponding to the desired gray levels of the pixels printed by the particular heaters. This is frequently accomplished by energizing the individual heaters repeatedly, with the number of times corresponding to the desired gray levels. This technique has the advantage of spreading out the heating of the elements in time thereby allowing for accurate dye transfer.

Another technique for energizing the individual heating element is described in U.S. Pat. No. 5,636,331 entitled "PATTERNED INTENSITIES PRINTER" which issued on Jun. 3, 1997 to Klinefelter et al. which is assigned to the same Assignee as the present application and is incorporated herein by reference. The technique described in Klinefelter et al. is advantageous because it requires fewer strobes of the heating element and is therefore faster than the simple pulsing technique mentioned above.

SUMMARY OF THE INVENTION

A printer for printing an image onto a substrate includes a thermal print head having a plurality of electrical resistors. A supply of coloring material adjacent the print head is provided for deposition on the substrate and a print head controller includes a pulse train output to at least one of the electrical resistors. The pulse train comprises a plurality of pulses. At least one pulse has a variable width related to a binary value and another pulse has fixed width.

DETAILED DESCRIPTION OF THE PREFERRED EMBODIMENTS

Figure 1:
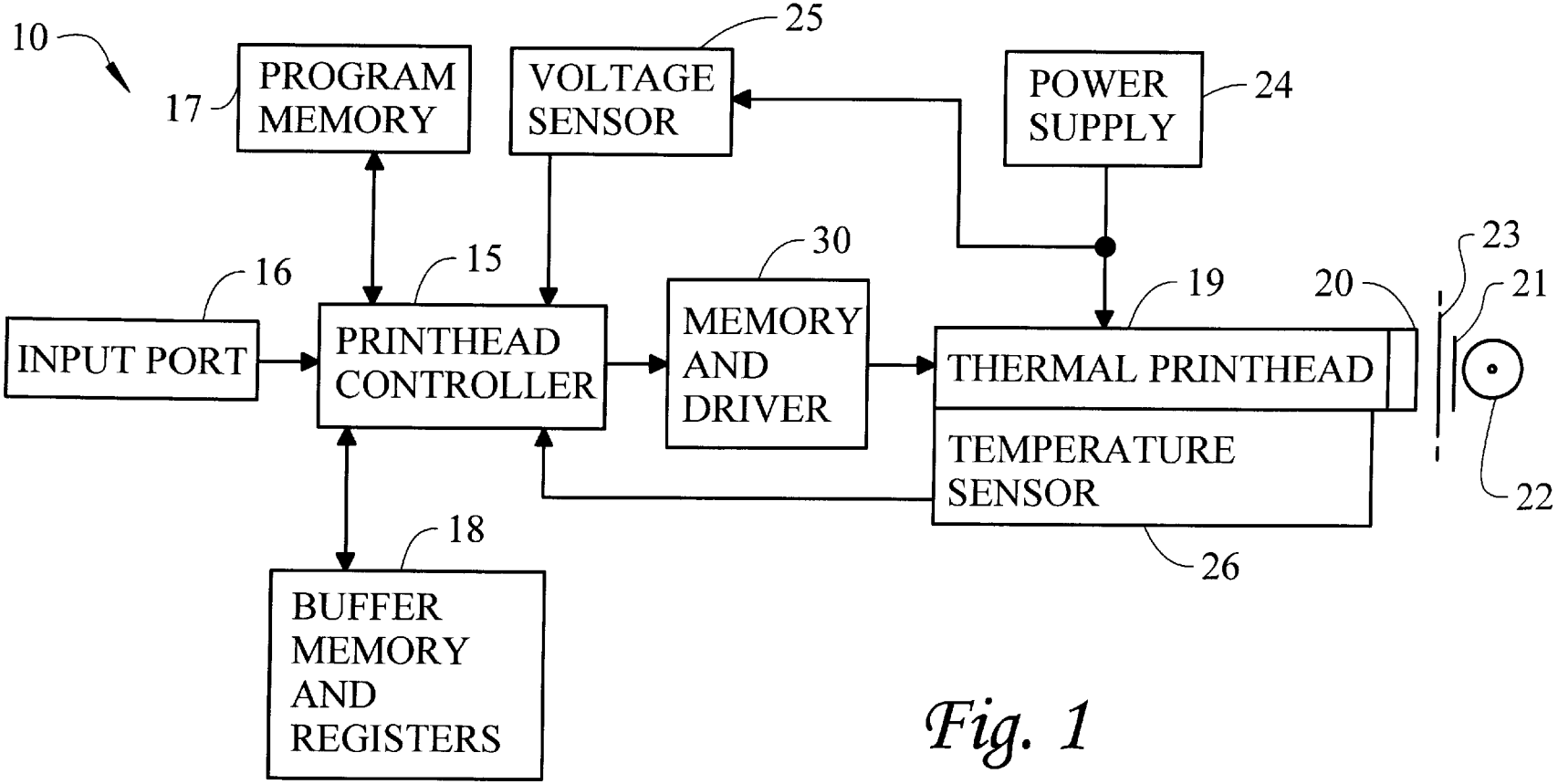
FIG. 1 is a simplified block diagram of a thermal printer in accordance with the present invention.
Figure 2:
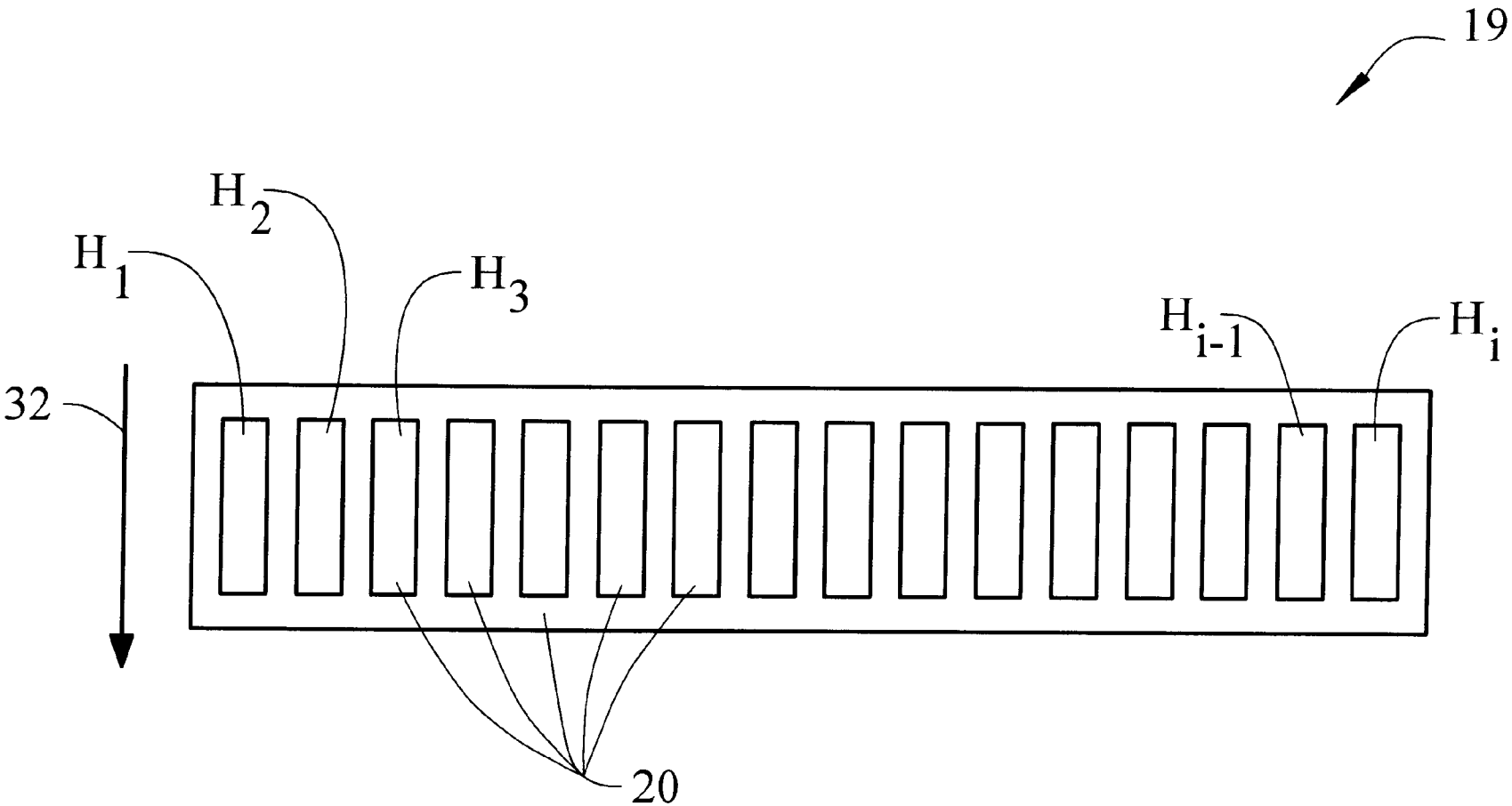
FIG. 2 is a front plan view of a thermal print head used in the thermal printer of FIG. 1.

FIG. 1 is a block diagram of a printer 10 in accordance with the present invention. A printer controller (such as a microprocessor) 15 is used to control the printing process. An input port 16 is capable of receiving signals from an output port of, for example, a computer (not shown) and communicate such signals along a bus to printer controller 15. Printer controller 15 has a non-volatile program memory 17 and a volatile memory 18. Memory 18 provides both buffer memory and registers for operation of printer controller 15. Printer controller 15 operates a thermal print head 19 having a plurality of electrical resistors 20 which are illustrated in FIG. 2. Resistors 20 are electrically isolated from each other and arrayed linearly along print head 18 in a line directed into the plane of the sheet onto which FIG. 1 is provided. The number of resistors 20 varies based upon the print head. However, in one preferred example, 768 resistors are used spaced along a length of 65 mm to provide a print density of 300 dots per inch (DPI). Resistors 20 are energized by print head controller using memory and driver 30 as explained below in greater detail. Thermal print head 19 is used to transfer coloring material from supply ribbon 23 onto substrate 21 which is pressed against print head 19 by roller 22. Substrates 21 can comprise, for example, an identification card blank, a paper sheet, or other appropriate material for receiving thermal printing. Ribbon 23 can comprise a dye sublimation, a thermal resin, or a wax based ribbon.

During printing, or coloring material deposition, an image line printing signal is shifted into memory 30 which acts as a shift register and provided to thermal print head 19 using a driver in memory and driver 13. As used herein, coloring material includes single color ribbons such as black, or multipanel color ribbons.Memory and driver 13 include at least one memory location for each resistor 20, and that memory location controls in part whether current flows into the resistor to which it corresponds.

FIG. 2 is a diagrammatic view of the active end of thermal print head 19 showing resistors 20 labeled $H_0$–$H_I$ where I is equal to the number of heaters on thermal print head 19 and therefore is also equal to the number of pixels per line to be printed on substrate 21. Substrate 21 is advanced past the stationary thermal print head 19 along with ribbon 23 in the direction identified by arrow 32 shown in FIG. 2. As substrate 21 is advanced, resistors 20 each print their respective pixel on each line. In this manner, thermal print head 19 prints one line at a time.

Print head 19 includes a series of integrated circuits, each responsible for controlling a group of resistive elements. In accordance with one preferred print head which is available from Kyocera of Kyoto, Japan, a print head is used which includes 10 such integrated circuits, each controlling 96 resistive elements. In one embodiment of the invention, only 8 such integrated circuits are used to control a total of 768 resistive elements. Each integrated circuit includes a data input capable of carrying one byte of information. Each byte of information is representative of a particular grey scale level (between 0 and 255) for an individual resistive element. The configuration is in accordance with Table 1:

TABLE 1

| DATA INPUT | C | RESISTOR (H) |
|---|---|---|
| Data Byte → 7 | IC7 | 672~767 |
| Data Byte → 6 | IC6 | 567~671 |
| Data Byte → 5 | IC5 | 480~575 |
| Data Byte → 4 | IC4 | 384~479 |
| Data Byte → 3 | IC3 | 288~383 |
| Data Byte → 2 | IC2 | 192~287 |
| Data Byte → 1 | IC1 | 96~191 |
| Data Byte → 0 | IC0 | 0~95 |

As illustrated in Table 1, data byte 0 (DBO) is used for providing data into ICO to control any of resistors $H_0$–$H_{95}$.

This is also true for, respectively, DB1 through DB7. Furthermore, a set of data to control a single line of resist developments comprising output bytes from print head controller 15 arranged as follows:

OB0, OB1, OB2, . . . OB767

TABLE 2

Thus, if the data from Table 1 is transferred in a linear manner into the integrated circuits 0–7 as illustrated in Table 1, first OB0 is transferred into ICO and pixel number 0 is written. Next, OB1 is transferred into IC0 and pixel number 1 is written. This continues, sequentially, all the way through OB767. However, in accordance with one aspect of the present invention, data is loaded into memory 30 and arranged in a manner to allow increased printing speed. For example, data can be loaded substantially simultaneously into IC0–IC7, and the resistive element ($H_0$, $H_{96}$, $H_{192}$, $H_{288}$, $H_{384}$ , $H_{480}$, $H_{576}$ and $H_{672}$) for each respective IC are written. One embodiment of this data configuration is illustrated in Table 3 in which the sequence of the output bytes has been rearranged such that data can be input into each respective integrated circuit in a more efficient manner and which is related to the order in which pixels are written on substrate 21.

OB0, OB96, OB192, OB288, OB384, OB480, OB596, OB672, OB1 . . . OB767

TABLE 3

Thus, in accordance with this aspect of the present invention, data is rearranged in a manner such that it is shifted into the appropriate integrated circuits in a more efficient manner thereby increasing the overall data transfer rate and increasing the printing rate.

Figure 3:
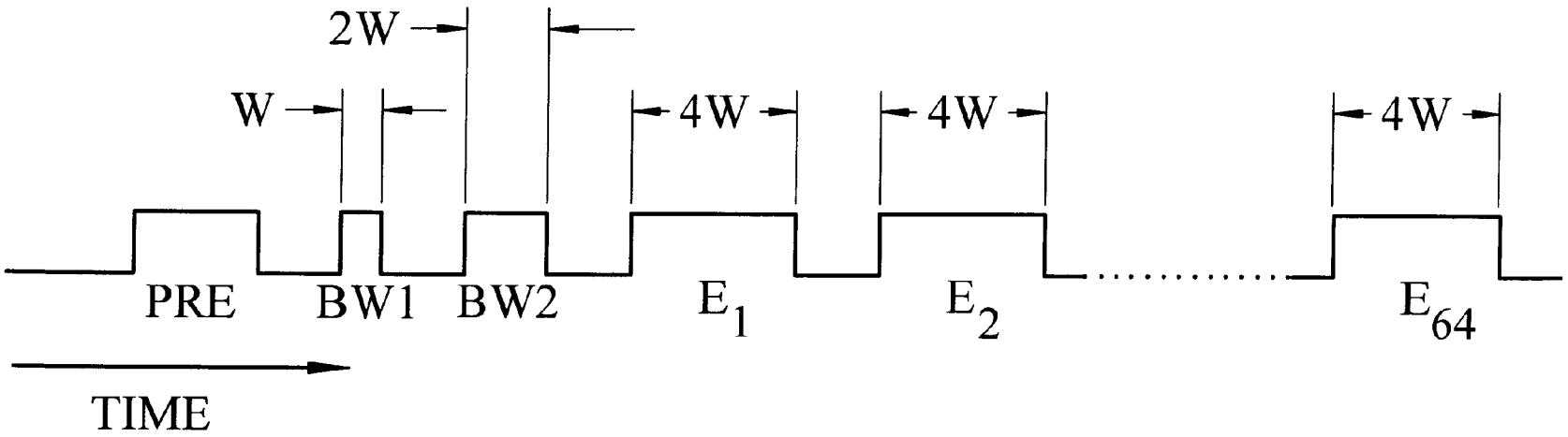
FIG. 3 is a timing diagram showing a pulse train applied to a resistive element of FIG. 2.

In accordance with another aspect of the present invention, the strobe pulses which are applied to resistor elements 20 include both binary weighted pulses and fixed length pulses. This technique provides a combination of the benefits of prior art fixed length strobing techniques along with the benefits of the binary weighted strobing techniques set forth in Klinefelter et al. U.S. Pat. No. 5,636,331. In accordance with this aspect of the present invention, one or more of the electrical pulses applied to resistive element 20 ($H_0$ . . . $H_I$) is a binary weighted pulse. Further, one or more of the pulses applied to another one of the resistive elements is a fixed length pulse. One such preferred embodiment is illustrated in the timing diagram of FIG. 3. FIG. 3 shows the train of pulses which are provided to an individual resistive element 20. The first pulse labeled PRE is the preheating or preburn pulse which raises the temperature of the heating element to the dye transfer heating level. The following series of pulses control the actual transfer of the dye. The first two pulses $BW_1$ and $BW_2$ are binary weighted pulses. $BW_1$ has a width of W and $BW_2$ has a width of 2W. The following strobe pulses $E_1$–$E_{64}$ also have a fixed width of 4W i.e., sustantially an integer multiple of W. This configuration allows a total of 256 levels to be achieved. Specifically, pulses $E_1$–$E_{64}$ provide 64 different binary level 4 adjustments while $BW_1$ provides a binary level 1 adjustment and $BW_2$ provides a binary level 2 adjustment. This allows a total of 256 different grey levels as illustrated in Table 4:

| Level | 1 | 2 | 3 | 4 | 5 | 6 | 7 | 8 | . . . |
|---|---|---|---|---|---|---|---|---|---|
| Pulses | $BW_1$ | | $BW_1$ | | $BW_1$ | | $BW_1$ | | . . . |
| | | $BW_2$ | $BW_2$ | | | $BW_2$ | $BW_2$ | | . . . |
| | | | | $E_1$ | $E_1$ | $E_1$ | $E_1$ | $E_1$ | . . . |
| | | | | | | | | $E_2$ | . . . |

This table can be generated using the following equations, where $GL_0$–$GL_7$ are the binary representation of a grey level having a range of 0–255:

$BW_1=GL_0$ $BW_2=GL_1$ if $GL_2$–$GL_7$ is >1, then $E_1=1$ if $GL_2$–$GL_7$ is >2, then $E_1$ and $E_2=1$ if $GL_2$–$GL_7$ is >3, then $E_{1,\ E2}$ and $E_3=1$ . . .

This technique is particularly advantageous because it is faster than the prior art technique in which each strobe has a fixed length. Further, it also provides advantages over the technique described in the Klinetelter et al. U.S. Pat. No. 5,636,331 because the present invention does not require dithering between bits and therefore requires less computation and gives higher resolution. Further, the fixed pulses provide a more equal heat distribution which improves the dye transfer characteristics of the ribbon to the substrate.

In another aspect of the present invention, the print head controller 15 utilizes the width of substrate 21 in determining the number of resistive elements 20 which need to be preheated or preburned using the PRE pulse illustrated in FIG. 3.

Specifically, if the substrate has a width which is less than the width of the print head or otherwise there are resistive elements on the print head which will not be used during the printing process, it is not necessary for those elements to be heated. This allows an overall reduction in the power consumption of the thermal print head 19 and reduces the amount of heat generated and latent heat retained in the print head. Furthermore, it increases component life time. Further still, because less heat is generated by thermal print head 20, problems associated with overheating of ribbon 23 such as wrinkling of the ribbon or other ribbon deformations are reduced. In accordance with this aspect of the invention, print head controller 15 either senses the width of substrate 21 or receives information regarding the width of the substrate 21 or the width of the image through input port 16 and selectively controls the pulse trains to those resistive elements 20 which are not required such that they do not receive the PRE pulse.

In accordance with techniques described in the Klinefelter U.S. Pat. No. 5,636,331, the overall voltage levels of the pulses in the pulse train can be controlled based upon the temperature of thermal print head 19 sensed using temperature sensor 26 shown in FIG. 1 as well as the voltage of power supply 24 sensed using voltage sensor 25. This feedback is used by the controller to provide greater accuracy in the thermal image transfer. Furthermore, printer controller 15 maintains a count of the number of pulses being applied to thermal print head 19 and responsively lengthens the duration of each strobe to compensate for $I^2R$ losses in the print head. More specifically, when large amount of current is flowing into the thermal print head 19 because a large number of pixels are being printed, the power delivered to each individual heating element drops for a strobe pulse of a given duration.

Therefore, by lengthening the duration of the strobe pulse, the power loss can be compensated.

The present invention provides two techniques for extending the print life of a thermal print head. These include reducing the applied power and reducing the switching of the circuits that turn the resistors for each printed pixel on and off.

Applied power has traditionally been adjusted for each resistor by adjusting the count and duty cycle of a series of pulses in a fixed voltage system. In one aspect, the pulse is always set to 100% duty cycle and the voltage is lowered to produce the same applied energy as the pulse adjustment method. Since the instantaneous power is reduced, less stress is applied to the resistive element material.

The second benefit of this method is reduced element switching. In a continuous tone thermal printer, a series of pulses is used to control the gray level of a printed pixel. Instead of a series of adjustable-width pulses in the old method, there is one continuous pulse made up of a series of timing intervals. The duration and count of timing intervals can be adjusted for each gray shade, but each resistive element is switched on and off only once for each image line. However, this technique can damage the print head using the former fixed, higher-voltage method. Reduced switching reduces unwanted component heating, and improves the accuracy of the printed shades.

In order to reduce microprocessor loading, a custom controller (for example in driver 30 of FIG. 1) can be used to control certain aspects of the print head signaling. For instance, the custom controller can sequence the timing intervals and thus control the gray levels for the image pixels being printed. The custom controller can also adjust the duration of the timing intervals based on the pixel count for each gray level. This type of pixel counting is used to adjust for wiring losses to the print head.

The present invention is preferably used with thermal printing processes such as dye sublimation processes. When used with wax or resin based processes, the present invention is capable of increasing the resolution of the printing process. In multi-color printing, the print head is used three times for each pixel with the appropriate primary colors to thereby accurately transfer the color image.

Although the present invention has been described with reference to preferred embodiments, workers skilled in the art will recognize that changes may be made in form and detail without departing from the spirit and scope of the invention. For example, any binary weighted pulse/fixed length pulse combination can be used and the pulse train applied to the heating elements. Furthermore, it is also possible to have the number or duration of the binary pulses shifted within the pulse train in a dynamic fashion. Similarly, the width of the fixed length pulses can also be changed dynamically to adjust for various printing configurations, desired resolutions or desired print speeds. The invention can be implemented as a method, in software, or as an apparatus.

What is claimed is:

1. A printer for printing an image onto a substrate, comprising:

a thermal print head having a plurality of electrical resistors;

a supply of coloring material adjacent the print head for deposition on the substrate;

a memory coupled to the print head having a plurality of memory locations, each coupled in a first sequence to a corresponding electrical resistor; and a print head controller adapted to receive a set of data bytes in a second sequence that is different from the first sequence, each byte corresponding to a gray scale setting for at least one electrical resistor, the controller including an output coupled to the memory to provide the set of data bytes to the memory in accordance with the first sequence.

2. The printer of claim 1, wherein the print head controller includes a pulse train output to at least one of the electrical resistors, the pulse train output comprising a plurality of pulses each having a voltage level, wherein the voltage levels of the pulses are the same, adjustable and are related to the gray scale of the image.

3. The printer of claim 1 wherein the controller provides a pulse train output to the print head comprising a plurality of pulses and wherein at least one pulse has a binary weighted width related to a binary valve and at least another pulse has a fixed width.

4. The printer of claim 3 wherein the pulse train includes a pulse having a second binary weighted width related to the binary value.

5. The printer of claim 3 wherein at least two of the pulses have a fixed width.

6. The printer of claim 3 wherein the fixed width is an integer multiple of the binary weighted width.

7. The printer of claim 3 wherein the pulse train output is a function of thermal feedback related to temperature of the print head.

8. The printer of claim 3 wherein a voltage level of the pulses is reduced to reduce increase print head lifespan.

9. The printer of claim 3 wherein the pulse train provides reduced element switching to thereby increase print head lifespan.

10. The printer of claim 1 wherein the print head controller includes a preburn pulse output coupled to only those resistor elements positioned within a width of the substrate.

11. The printer of claim 1 wherein the first sequence corresponds to an order of resistance elements in the print head.

12. The printer of claim 1 wherein the supply comprises a ribbon carrying a dye.

13. The printer of claim 1 wherein the supply comprises a ribbon carrying a wax.

* * * * *

UNITED STATES PATENT AND TRADEMARK OFFICE

CERTIFICATE OF CORRECTION

PATENT NO. : 6,384,854 B1
DATED : May 7, 2002
INVENTOR(S) : Ibs et al.

It is certified that error appears in the above-identified patent and that said Letters Patent is hereby corrected as shown below:

Title page,
Item [75], Inventors: replace "John J. Ibs" with -- Jon J. Ibs --
Item [56], References Cited, U.S. PATENT DOCUMENTS, replace "Kayano" with -- Koyano --

Column 2,
Table 1, in the heading replace "C" with -- IC --
Line 28, cancel "ribbons.Memory" and insert -- ribbons. Memory --
Line 67, cancel "DBO" and insert -- DB0 -- (zero)
Line 68, cancel "ICO" and insert -- IC0 -- (zero)

Column 3,
Line 3, cancel "developments" and insert -- elements --
Line 12, cancel "ICO' and insert -- IC0 --

Column 6,
Line 27, cancel "valve" and insert -- value --
Line 40, cancel "reduce increase"

Signed and Sealed this

Twenty-eighth Day of January, 2003

JAMES E. ROGAN
*Director of the United States Patent and Trademark Office*